United States Patent [19]

Zurek et al.

[11] Patent Number: 4,726,137

[45] Date of Patent: Feb. 23, 1988

[54] CLEANING DEVICE FOR GUNS

[75] Inventors: Rudolf Zurek, Groebenzell; Ferenc Kotai; Markus Spoetzl, both of Munich; Leonhard Pongratz, Karlsfeld, all of Fed. Rep. of Germany

[73] Assignee: Krauss-Maffei A.G., Fed. Rep. of Germany

[21] Appl. No.: 698,392

[22] Filed: Feb. 5, 1985

[30] Foreign Application Priority Data

Feb. 7, 1984 [DE] Fed. Rep. of Germany ..... 3404246

[51] Int. Cl.[4] ..... F41F 17/14

[52] U.S. Cl. ..... 42/95; 15/104.1 R; 15/104.2; 15/104.09; 74/625

[58] Field of Search ..... 42/1 BC; 15/104.1 R, 15/104.2, 104.16, 104.09; 254/95; 74/625

[56] References Cited

U.S. PATENT DOCUMENTS

| | | | |
|---|---|---|---|
| 473,821 | 4/1892 | Carbis | 15/104.1 R |
| 514,514 | 2/1894 | Stafford | 15/104.16 |
| 531,039 | 12/1894 | Hunt | 15/104.1 R |
| 944,973 | 12/1909 | Smith | 15/104.09 |
| 944,974 | 12/1909 | Smith | 15/104.09 |
| 1,862,976 | 6/1932 | Merneck | 254/95 |
| 2,019,761 | 11/1935 | Mitchell | 15/104.09 |
| 2,601,691 | 7/1952 | Dyer | 15/104.2 |
| 2,792,807 | 4/1957 | Cummings | 15/104.09 |
| 2,798,238 | 7/1957 | Rogovin | 15/104.16 |
| 2,803,842 | 8/1957 | Fuller | 15/104.1 R |
| 2,891,268 | 6/1959 | Cheadle | 15/104.2 |
| 3,354,490 | 11/1967 | Masters et al. | 15/104.1 R |
| 3,400,419 | 9/1968 | Fuller | 15/104.1 R |
| 3,480,982 | 12/1969 | Saunders | 15/104.2 |
| 3,736,909 | 6/1973 | Marangoni et al. | 15/104.16 |
| 4,015,304 | 4/1977 | Dillinger | 15/104.1 R |
| 4,166,301 | 9/1979 | Smith | 15/104.04 |
| 4,266,709 | 5/1981 | Kruger . | |
| 4,290,163 | 9/1981 | Opitz et al. | 15/104.09 |
| 4,369,071 | 1/1983 | Flach et al. | 15/104.09 |
| 4,440,050 | 4/1984 | Kagerer | 74/625 |

FOREIGN PATENT DOCUMENTS

| | | | |
|---|---|---|---|
| 2839153 | 3/1980 | Fed. Rep. of Germany | 15/104.09 |
| 738693 | 6/1980 | U.S.S.R. | 15/104.16 |

*Primary Examiner*—Deborah L. Kyle
*Assistant Examiner*—Michael J. Carone
*Attorney, Agent, or Firm*—Robert J. Koch

[57] ABSTRACT

A cleaning device for guns in which a cleaning brush fastened to a brush carrier is moved to-and-fro in the barrel by means of a rod. A drive unit with drive wheels which can be engaged with the rod is arranged in the front of the muzzle of the gun so that the cleaning operation can be simply carried out with a small expenditure of time and labor.

21 Claims, 7 Drawing Figures

DRIVE
II
II
a
b
c

CLEANING DEVICE FOR GUNS

BACKGROUND OF THE INVENTION

The present invention relates to a cleaning device for guns.

In the known cleaning devices, cleaning brushes are moved to-and-fro in the barrel interior by means of rods fastened to the brush carrier. Where a large-bore weapon is concerned, a cleaning process of this type requires an attendance crew of several men and a considerable expenditure of time and labor.

Motor-driven barrel-cleaning devices are also known (German Offenlegungsschrift No. 2,839,153), and these can be introduced into the barrel as a cleaning unit and move forwards and backwards in the barrel essentially automatically; the translational drive takes place via drive wheels pressed against the inner wall of the barrel. However, a barrel-cleaning device of this type requires a high outlay in terms of production and maintenance. Furthermore, thermal problems can arise as a result of insufficient cooling facilities on the electric motor operating in the barrel interior.

SUMMARY OF THE INVENTION

An object of the invention is, therefore, to provide a barrel-cleaning device which, while ensuring simple production and simple handling, makes it possible to clean the gun so as to save time and labor.

This object is achieved by means of the features of the gun-cleaning device according to the present invention.

An advantage of the solution according to the present invention is, in particular, that standard cleaning appliances adopted by the troops can be used. Cleaning work on a 120-mm gun, hitherto requiring up to 7 men and up to 21 man hours, is executed by means of a drive unit containing, for example, one or more electric motors, the electric motor being connectable to the supply system of a troop carrier.

The drive unit is preferably releasably fastened to the muzzle end of the barrel, but can also be arranged on the carriage supporting the gun or on a separate vehicle.

However, on a battle tank, the preferred embodiment involves arranging the drive unit on the muzzle end of the barrel and supplying the drive motor means of the supply system of the battle tank.

The drive unit is appropriately provided with a friction drive which allows the rod to be introduced laterally be means of wheels arranged on a clamping mechanism. The clamping mechanism offers the further advantage that the pressing force of the friction wheels can be adjusted as desired.

In the event that particularly high forces are to be transmitted, a positive drive may be advantageous. For this purpose, the rod may also be equipped with a rack element engaged with a drive pinion of the drive unit. In this embodiment, there is also an appropriate clamping mechanism which, in its open position, guarantees the lateral introduction of the rod; and, in its closed position, guarantees perfect meshing by means of a counter-roller located opposite the drive pinion. The drive unit may also be equipped with an angle of rotation sensor.

In a preferred embodiment, the drive unit is arranged on a supporting arm fastened to the muzzle end of the barrel. As a result, it is possible to ensure a distance from the muzzle making it possible for the rod and the brush together to be drawn out of the barrel. It is expedient, for this purpose, to fasten an insertion funnel on the supporting arm. The funnel guarantees that the cleaning brush will be introduced into the barrel without difficulty.

To support the rod end projecting beyond the drive unit, the supporting arm is advantageously extended beyond the drive unit and carries a supporting device on its end. The rod can thus be prevented from sagging excessively, even when the cleaning brushes are in a drawn-out position; and the drive elements of the drive unit remain engaged with the rod substantially free of bending movement.

To exert the considerable pushing and pulling forces on the rod, the drive wheels of the drive unit are advantageously coupled to the motor via a gear transmission. The motor can appropriately be supplied from the power source and the gun support system. Vehicle batteries or hydraulic pressure-medium sources may also serve as power sources for this purpose.

In the case of a battle tank, the motor of the drive unit preferably comprises an electric motor which can be connected to the supply system fed by the vehicle battery.

In the case of other weapon system, such as a howitzer equipped only with an hydraulic auxiliary drive, for example, the motor of the drive unit appropriately comprises an hydraulic motor which can be connected to the pressure-medium source of the hydraulic auxiliary drive.

So that emergency operation can be guaranteed in the event of failure of the drive motor or of the power source, it is recommended to equip the gear transmission with a coupling mechanism for one or more crank handles.

The rod can be composed of individual component elements or can consist of a telescopically extendable tube which can be locked in the drawn-out position. The rod thickness, which changes in steps in a rod of the latter type, is compensated by drive wheels of the drive unit which are pressed resiliently up against the rod.

In order to produce a rotation of the cleaning brush by means of the drive unit at the same time as the longitudinally axial to-and-fro movement, the axes of the drive wheels of the drive unit may be set obliquely relative to the axis of the rod.

In this embodiment the cleaning brushes can also be made to rotate because the drive wheels engaged with the rod are arranged so as to be rotatable about the rod axis along with the rod. The parts rotating with them may include, if appropriate, the gear transmission and the electric drive. In the latter case the electric drive may be supplied with current and controlled via sliding contacts.

In another embodiment, one or more longitudinal members serve as a drive system. The longitudinal members are fastened parallel to the axis of the barrel and project beyond the barrel. In this embodiment, a traction unit coupled to the mounting of the rod is provided which can be moved to-and-fro on the longitudinal members.

There are many possibilities for drive means for this traction unit. Thus, for example, the to-and-fro movement may be executed via a friction drive, in which friction wheels mounted on the traction unit interact with a running rail on the longitudinal member.

Furthermore, the to-and-fro movement may also be produced by means of drive pinions arranged on the traction unit and racks arranged on the longitudinal member.

Finally, the to-and-fro movement may also be achieved by mounting a deflecting roller on the outer end of the longitudinal member and, in the region of the latter, and at the muzzle of the gun, respectively guiding a cable or chain around these deflecting rollers which is connected to the traction unit. By coupling a drive motor fixed in place, or fixed to the longitudinal member, to the axle of one of the two deflecting rollers, the traction unit, together with the rod and cleaning brush, may be displaced in any desired manner in the longitudinally axial direction.

A further embodiment of the invention is particularly well-suited for weapon systems in which a hydraulic pressure-medium source is available for driving hydraulic auxiliary devices.

An electro-hydraulic unit which can be connected, for example, to the supply system of a troop carrier may be used as a drive for the telescopically extendable and retractable tube.

Stop elements may be arranged on the rod to control the to-and-fro movement of the cleaning brush. Limit switches provided on the drive unit can be controlled by means of these stop elements.

In another advantageous embodiment, the control devices are integrated in the gear transmission or in the motor of the drive unit, so that the longitudinally axial movements of the cleaning brushes can be determined by means of adjustable rotation speeds of the motor or transmission shafts.

The control device may advantageously include angle-of-rotation sensors arranged on the drive unit and particularly the gear transmission or the motor for detecting rotation. In a further advantageous embodiment, the claimed device may include two groups of brushes and a drive mechanism in the brush carrier for rotating the two groups of brushes in opposite directions. Additionally, an electric motor may be disposed within said brush carrier and coupled with the drive mechanism. A further advantageous embodiment may include means for introducing operating fluids to the brush carrier where the operating fluids may be cleaning fluids, rinsing fluids, preserving fluids, or compressed air.

Further objects, features and advantages of the present invention will become apparent from the detailed description of preferred embodiments which follows when considered together with the enclosed figures of drawing.

DETAILED DESCRIPTION OF THE PREFERRED EMBODIMENTS

Figures 1, 2:
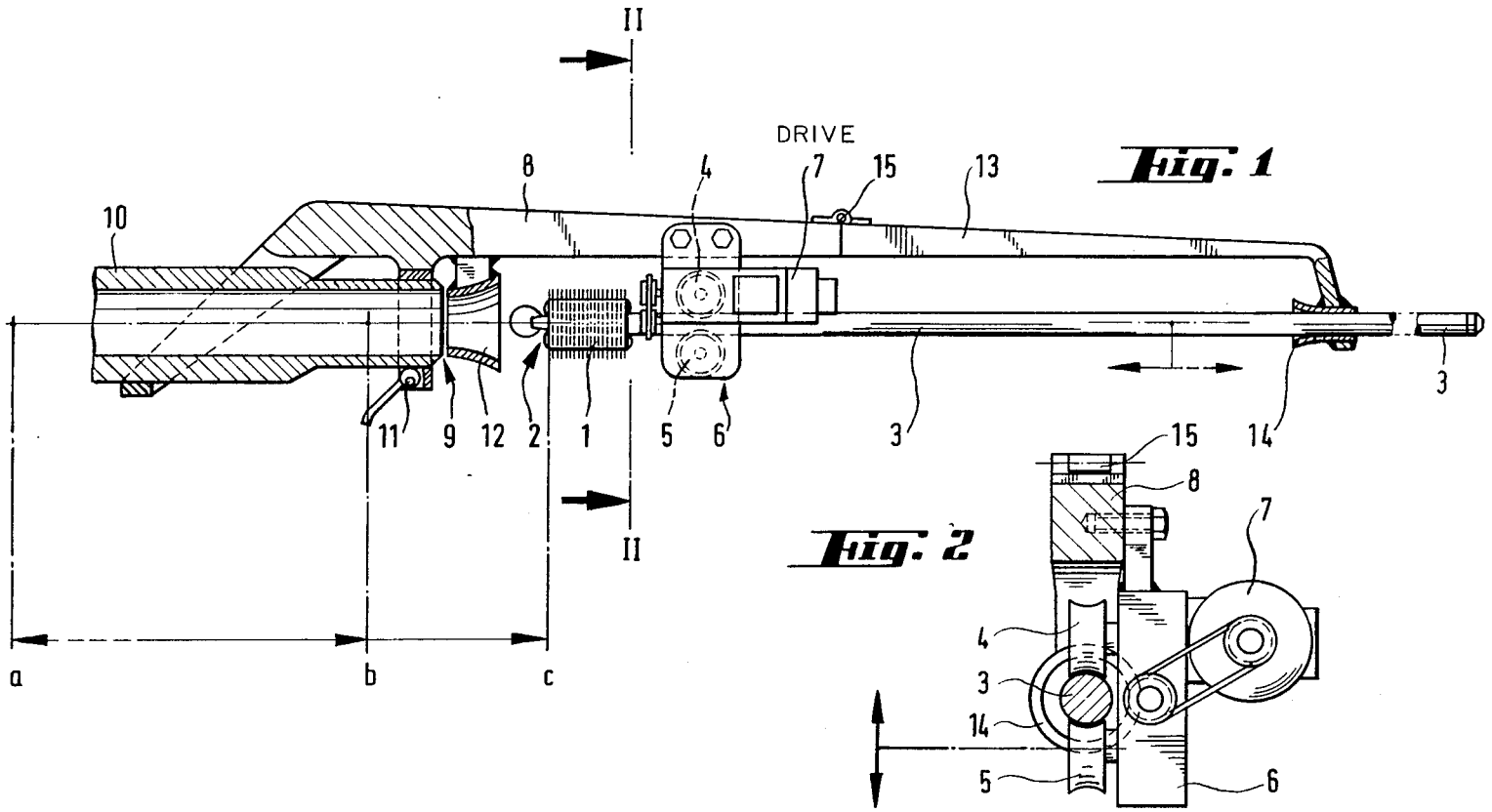
FIG. 1 shows a section through the muzzle region of a gun with a cleaning device fastened to it and with the cleaning brush drawn out.
FIG. 2 shows a sectional view according to the sectional line II—II in FIG. 1.
Figure 3:
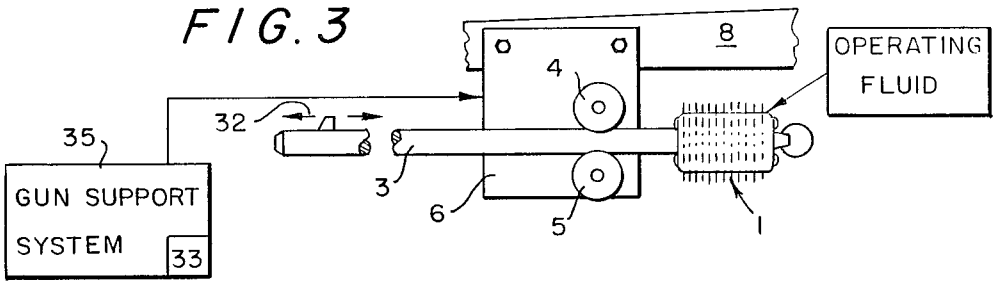
FIG. 3 shows a clamping mechanism connected to a drive wheel.

FIGS. 1 and 2 show an automatic cleaning device which employs a conventional cleaning appliance used by troops and comprising a cleaning brush 1, a brush carrier 2 and a rod 3. The rod 3 is clamped between two drive wheels 4 and 5 designed as friction wheels. The drive wheels are mounted in a drive unit 6 which contains a gear transmission (not shown) and to which a drive motor 7 is fastened. Of the two drive wheels 4 and 5, the lower drive wheel 5 has a pivot mounting 31 (FIG. 3.) By means of the pivot mounting, the lower drive wheel 5 can be deflected perpendicularly to its axis and to the axis of the rod 3 thereby clamping the rod.

The drive unit 6 is screwed to a supporting arm 8 which is fastened to the muzzle end 9 of a gun 10 by means of a clamping device 11. The supporting arm 8 also has an insertion funnel 12 which can be positioned in front of the muzzle of the gun 10, and an extension arm 13. A supporting device for supporting the rod 3 in the form of a guide sleeve 14 and widened like a funnel, is fastened to the end of the extension arm 13. The extension arm 13 can be swung back against the supporting arm 8 by means of a hinge joint 15.

To operate the cleaning device, the supporting arm 8 is first fastened to the muzzle of the gun 9 by means of the clamping device 11, and the extension arm 13 with the guide sleeve 14 is swung forward. Subsequently, the rod 3 is introduced into the guide sleeve 14 by its rear and is inserted laterally between the separated drive wheels 4 and 5 by means of its front end, the end carrying the cleaning brush. After the lower drive wheel 5 has been swung up, the rod 3 is clamped firmly between the drive wheels 4 and 5, thus achieving a secure frictional connection for the transmission of high forces working in the longitudinally axial direction.

In the position illustrated in FIG. 1, the cleaning brush is in the initial or maintenance position c, in which the cleaning brush is freely accessible. After the cleaning brush has been introduced into the barrel via the insertion funnel, the cleaning brush is moved to-and-fro between the positions b and a, of which the position a is not shown and is in the region of the breech plate of the gun 10.

FIG. 3 shows the gun support system 35 supplying power to drive unit 6. Control devices 33 are schematically shown for integration with a gear transmission (not shown) or in the motor of drive unit 6. Adjustable stop elements 32 are arranged on the rod 3 to control the cleaning brush movement. Lower wheel 5 is shown having a pivot mounting 31.

Figure 4:
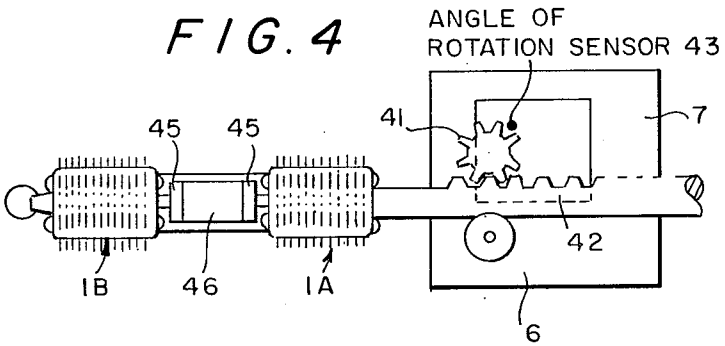
FIG. 4 shows a gear drive unit and a double brush configuration.

FIG. 4 shows two brushes 1A and 1B and drive mechanism 45 for rotating the brushes in opposite directions. Electric motor 46 is disposed within the brush carrier and is coupled with drive mechanism 45.

Instead of a friction drive, it is also possible to use a gear-wheel drive 41, (FIG. 4), in which case the rod 3 must be equipped with a rack 42.

The drive unit 6 can also be equipped with a telescopically acting hydraulic drive (not shown). In this case, a tube which can be introduced and drawn out telescopically is arranged on the drive unit 6. The brush carrier with the cleaning brush is fastened to the free end of the telescopic tube.

Figure 6:
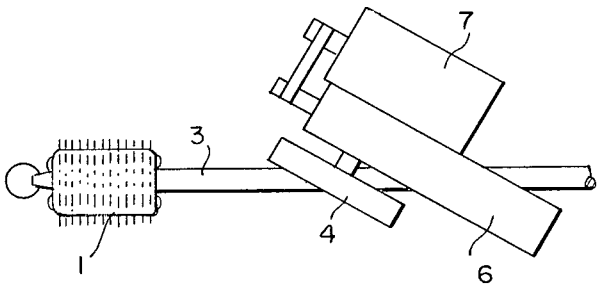
FIG. 6 shows an obliquely set drive unit.
Figure 7:
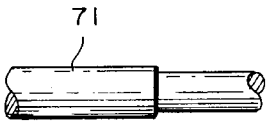
FIG. 7 shows a telescoping rod.
Figure 5:
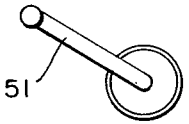
FIG. 5 shows a crank handle that may be attached to the cleaning device of FIG. 1.

FIG. 5 shows a crank handle 51 for connection to the drive unit. FIG. 6 shows a device where the drive wheels are set obliquely to the axis of the rod 3. FIG. 7 shows a portion of a telescopically extendable tube 71.

In principle, cleaning can also be carrier out be means of a device in which one or more longitudinal members are fastened to the barrel, project beyond the barrel, and are arranged so as to be parallel to the axis of the barrel. The rod has a mounting at its free end, coupled to a traction unit, which can be moved to-and-fro on one or more of the longitudinal members. For moving to-and-fro the traction unit can have a friction or gear-wheel drive which is engaged with an appropriately designed running surface on the longitudinal member.

The longitudinal movement can also be effected by means of a spindle which is bearingly supported at both ends of the longitudinal member and which extends through a spindle nut located in the traction unit, the traction unit being mounted on the longitudinal member so as to be fixed in terms of rotation and longitudinally displaceable. The advantage of this arrangement is that the rotary drive for the spindle can be arranged fixed in place at one of the two bearing points of the spindle on the longitudinal member.

The same advantage is obtained in a device in which the traction unit is guided on a longitudinal member so as to be fixed in terms of rotation and longitudinally displaceable. In this embodiment, the to-and-fro movement is produced via an endless chain which is connected firmly to the traction unit. The endless chain is wound around a first deflecting wheel mounted in the muzzle region and a second deflecting wheel mounted in the free end of the longitudinal member. The axle of one of the two deflecting wheels is provided with a rotary drive, and the axle of the other deflecting wheel can be provided with a coupling for coupling a crank handle.

What is claimed is:

1. A field weapon barrel cleaning device comprising:
a brush carrier;
at least one cleaning brush arranged on the brush carrier;
a cleaning rod attached to the brush carrier;
a drive unit disposed outside of the barrel for engaging the rod and moving the rod and attached brush carrier back and forth;
a plurality of drive wheels connected to said drive unit for engaging said rod;
means for releasably fastening said drive unit to an end of said barrel;
a supporting arm for holding said drive unit in front of and at a distance from said end of said barrel; and
wherein said supporting arm extends in an axially parallel direction with respect to the longitudinal axis of said barrel beyond said drive unit and away from the barrel, and comprises rod support means for supporting the rod.

2. A device as recited in claim 1, wherein said drive unit comprises a friction drive.

3. A device as recited in claim 2, further comprising a clamping mechanism for holding said drive wheels having an open position wherein said rod can be introduced laterally between the drive wheels, and a closed position wherein the drive wheel frictionally engage the rod.

4. A device as recited in claim 1, wherein said drive unit comprises a gear-wheel drive, and wherein said rod comprises meshing means for engaging the gear wheel drive.

5. A device as recited in claim 4, further comprising a clamping mechanism having an open position for laterally engaging said rod, and a closed position for holding said rod in engagement with said gear-wheel drive.

6. A device as recited in claim 1, further comprising an insertion funnel for guiding said cleaning brush into said muzzle end, and arranged on said supporting arm.

7. A device as recited in claim 1, further comprising a motor and a gear transmission for driving said drive unit.

8. A device as recited in claim 7, further comprising a gun support system, having a motor wherein said gun support system motor also functions as said motor for said drive unit.

9. A device as recited in claim 7, further comprising a crank handle coupled to said gear transmission, and wherein said drive unit may be alternately driven by said crank handle and gear transmission.

10. A device as recited in claim 7, further comprising control devices integrated into said drive unit for adjustably controlling said drive unit.

11. A device as recited in claim 10, wherein said control device comprise angle-of-rotation sensors arranged on said drive unit for detecting rotation.

12. A device as recited in claim 1, wherein said drive wheels are set obliquely to the axis of the rod so that the rod is moved back and forth with a longitudinal axial movement and a rotary movement.

13. A device as recited in claim 1, wherein the drive wheels rotate in a plane intersecting an axis of the rod.

14. A device as recited in claim 1, wherein said rod comprises a telescopically extendable tube and means for locking the tube in its extension.

15. A device as recited in claim 1, further comprising stop elements and limit switches for interacting with the stop elements and for controlling said drive unit.

16. A device as recited in claim 15, wherein said stop elements are adjustably fastened to said rod.

17. A device as recited in claim 1, comprising two groups of brushes and a drive mechanism in said brush carrier for rotating the two groups of brushes in opposite directions.

18. A device as recited in claim 17, further comprising an electric motor disposed within said brush carrier and coupled with said drive mechanism.

19. A device as recited in claim 17, further comprising a motor located outside of the barrel and force transmission elements for coupling the drive mechanism with the motor.

20. A device as recited in claim 1, further comprising means for introducing operating fluids to the brush carrier.

21. A device as recited in claim 20, wherein said operating fluids are selected from the group consisting of: cleaning fluids, rinsing fluids, preserving fluids and compressed air.

* * * * *